US008905581B1

(12) United States Patent
Pan

(10) Patent No.: US 8,905,581 B1
(45) Date of Patent: Dec. 9, 2014

(54) COUPLING STRUCTURE OF FLEXIBLE CORE AND FLEXIBLE BASE OF LED CHRISTMAS LIGHT STRING

(71) Applicant: Kuo-Wei Pan, Hsinchu (TW)

(72) Inventor: Kuo-Wei Pan, Hsinchu (TW)

( * ) Notice: Subject to any disclaimer, the term of this patent is extended or adjusted under 35 U.S.C. 154(b) by 0 days.

(21) Appl. No.: 14/060,632

(22) Filed: Oct. 23, 2013

(51) Int. Cl.
*F21V 21/00* (2006.01)
*F21S 4/00* (2006.01)

(52) U.S. Cl.
CPC ..... *F21S 4/001* (2013.01)
USPC ..... 362/249.08; 362/249.19; 362/363

(58) Field of Classification Search
USPC ..... 362/249.08, 249.19, 363
See application file for complete search history.

(56) References Cited

U.S. PATENT DOCUMENTS

2010/0067242 A1* 3/2010 Fung ..... 362/363

* cited by examiner

*Primary Examiner* — Mary Ellen Bowman
(74) *Attorney, Agent, or Firm* — Leong C. Lei

(57) ABSTRACT

The present invention provides a coupling structure of a flexible core and a flexible base of a Christmas light string, which is applicable to a Christmas light string, in which a Christmas light is formed of a combination of a flexible core, a flexible base, an LED, and electrical wires and multiple Christmas lights are combined to form a Christmas light string. The features of the present invention are that a flexible core has a bottom on which two bearing seats are formed to support two terminal pins of an LED and having bottom edges in which folding notches are formed in such an arrangement that one is relatively high while the other is relatively low, whereby the two terminal pins of the LED, after being folded about the bearing seats, both provide an extended exposed portion for engagement with the conductive pad of the corresponding electrical wire.

2 Claims, 3 Drawing Sheets

COUPLING STRUCTURE OF FLEXIBLE CORE AND FLEXIBLE BASE OF LED CHRISTMAS LIGHT STRING

(a) TECHNICAL FIELD OF THE INVENTION

The present invention generally relates to an improvement of a structure of a Christmas light string, and more particularly to an improvement of a coupling structure of a flexible core and a flexible base of each Christmas light that constitutes, in part, a Christmas light string.

(b) DESCRIPTION OF THE PRIOR ART

A conventional LED Christmas light string comprises Christmas lights each of which has a structure shown in FIG. 1 and generally comprises a flexible core (10), a flexible base (20), an LED (Light-Emitting Diode) (30), and two electrical wires (40). The flexible base (20) has a top forming a cavity for receiving the flexible core (10) to insert therein. The two electrical wires (40) have ends to which conductive pads (41) are attached and are inserted into the flexible base (20) through a bottom opening thereof to be respectively set on an inner circumferential surface of the flexible base (20) to be opposite to each other. The flexible core (10) has a top forming a cavity for receiving the LED (30) to insert therein and a bottom comprising a spacer plate (11) formed at a center thereof. The spacer plate (11) has opposite sides on which bearing seats (12) are respectively formed for receiving terminal pines of LED (30) to insert therein. The two bearing seats (12) have bottom edges in which folding notches (121) of the same sizes are respectively formed to respectively receive the terminal pins of the LED (30) to penetrate through for further folding. However, the terminal pins of LED (30) are different from each other for being of positive and negative electrical polarities and thus the two terminal pins are made in an arrangement that one is relatively long while the other is relatively short for the purposes of distinction. Due to the lengths of the two terminal pins being different, when the two terminal pins of the LED (30) are inserted into the bearing seat (12) and subsequently folded upwards upon penetrating through the folding notches (121), the folded and thus exposed portions of the terminal pins would be of different sizes. Thus, after the flexible core (10) is inserted into and coupled to the flexible base (20), the contact areas respectively established between the two terminal pins of the LED (30) and the conductive pads (41) of the two electrical wires (40) are different. The voltage of the electricity supplied through the electrical wires (40) to the LED (30) will be unstable due to the great difference of the contact areas. This would readily lead to damage of the LED (30) and consequently, the life span of the LED (30) is reduced. Such an arrangement is generally imperfect and further improvement is thus desired.

SUMMARY OF THE INVENTION

In view of the problems that the structural drawbacks of the Christmas lights of an LED Christmas light string that leads to shortened life span of the LEDs, the present invention aims to provide a solution to overcome such problems.

In order to overcome the above discussed drawbacks of the conventional LED Christmas light string, the present invention provides a coupling structure of a flexible core and a flexible base of a Christmas light string, of which the features are that a flexible core has a bottom on which two bearing seats are formed to support two terminal pins of an LED and having bottom edges in which folding notches are formed in such an arrangement that one is relatively high while the other is relatively low so that the folding notch that receives the long terminal pin of the LED to penetrate therethrough defines an opening that is relatively short in the vertical direction, while the folding notch that receives the short terminal pin of the LED to penetrate therethrough defines an opening that is relatively long in the vertical direction, whereby the two terminal pins of the LED that are of different lengths, after being folded about the bearing seats, both provide an extended exposed portion for engagement with the conductive pad of the corresponding electrical wire and thus the electricity supplied through the two terminal pins can be of a stable voltage to thereby extend the life span of the LED.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
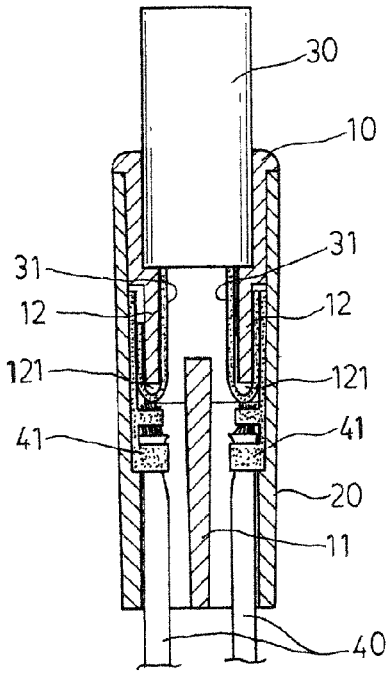
FIG.1 PRIOR ART
FIG. 1 is a schematic view illustrating a structure of a conventional LED (Light-Emitting Diode) Christmas light.
Figure 2:
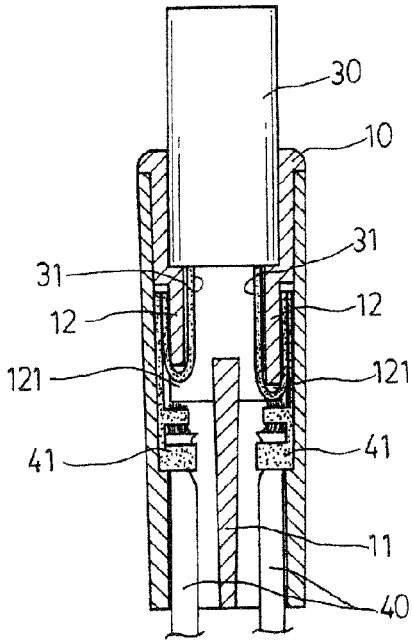
FIG. 2 is a schematic view showing an LED Christmas light, in an assembled condition, according to the present invention.
Figure 3:
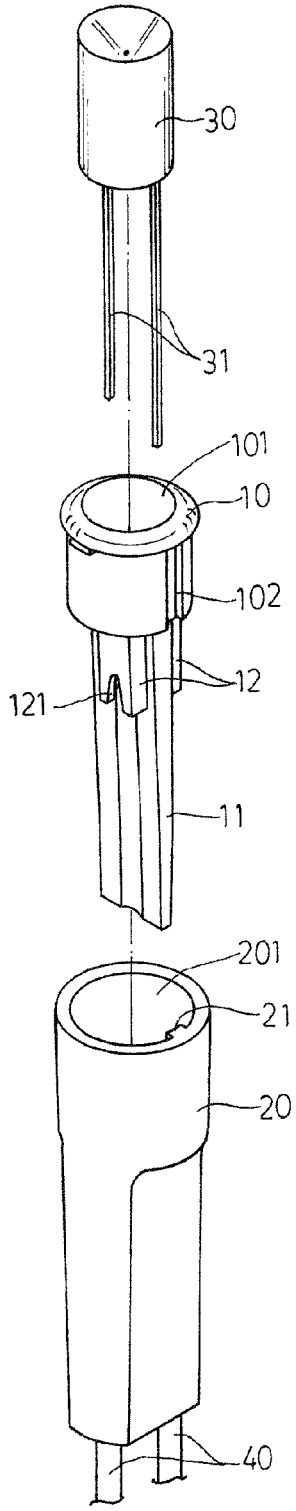
FIG. 3 is a perspective view, in an exploded form, showing the LED Christmas light according to the present invention.
Figure 4:
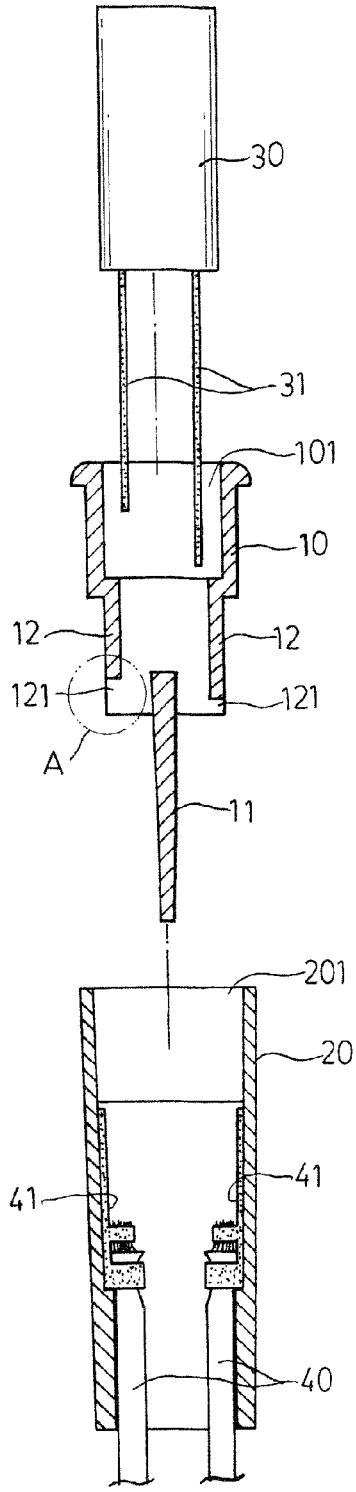
FIG. 4 is a cross-sectional view, in an exploded form, showing the LED Christmas light according to the present invention.

Referring to FIGS. 2, 3, and 4, the present invention provides a coupling structure of a flexible core and a flexible base of a Christmas light string, in which each of Christmas lights of the Christmas light string has a structured that comprises a flexible core (10), a flexible base (20), an LED (Light-Emitting Diode) (30), and two electrical wires (40). The flexible core (10) has a top forming an open cavity (101) and an outer circumferential surface in which a groove (102) is defined and also has a bottom comprising a spacer plate (11) formed at a center thereof. The spacer plate (11) has an upper portion having two opposite sides each forming a bearing seat (12). The flexible base (20) has a top forming an open cavity (201). The open cavity (201) has an inner circumferential surface on which a projection (21) that has a size corresponding to the groove (102) is formed at a location corresponding to the groove (102) of the flexible core (10). The LED (30) has a bottom from which two terminal pins (31), of which one is long and the other is short, extend. The two electrical wires (40) each have an end to which a conductive pad (41), which is made of a copper based material, is mounted. The features of the present invention is that the two opposite bearing seats (12), which are arranged at the bottom of the flexible core (10), each have a bottom edge in which a folding notch (121) is formed so that the two folding notches (121) are of a one-high-one-low arrangement, meaning one of the folding notches (121) forming an opening in a wall of the bearing seat that is longer, in the vertical direction, while the other one of the folding notches (121) forming an opening in a wall of the associated bearing seat that is shorter.

Still referring to FIGS. 2, 3, and 4, the two electrical wires (40) are inserted, through an opening in a bottom of the flexible base (20), into the flexible base in such a way that the conductive pads (41) mounted at the ends of the wires are respectively set on the inner circumferential surface of the flexible base (20) to be opposite to each other. The LED (30) is inserted, with a bottom portion thereof, into the open cavity (101) of the flexible core (10) in such a way that the two terminal pins (31) are respectively inserted into the bearing seats (12) so that a long one of the LED terminal pins (31) penetrates through the folding notch (121) of shorter opening and is folded upwards, while a short one of the LED terminal pins (31) penetrates through the folding notch (121) of longer opening and is folded upwards. As such, the two terminal pins (31) that are folded to overlap the walls of the bearing seats (12) provide an extended exposed portion. The flexible core (10) is then position, with the groove (102) thereof aligning with the projection (21) of the open cavity (201) of the flexible base (20), to be inserted into the open cavity (201) of the flexible base (20). Under this condition, the two LED terminal pins (31) that are of different lengths both provide an extended portion that is exposed to engage the conductive pad (41) of the corresponding electrical wire (40), whereby an electrical current flowing through the two terminal pins (31) can be stabilized in respect to the voltage thereof so as to enhance the life span of the LED.

Figure 5A:
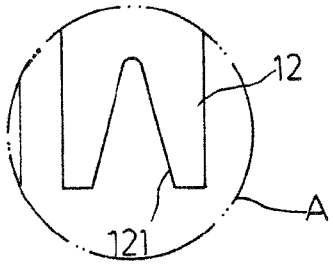
FIGS. 5A-5C illustrate modifications of a bending notch of the flexible core according to the present invention.
Figure 5B:
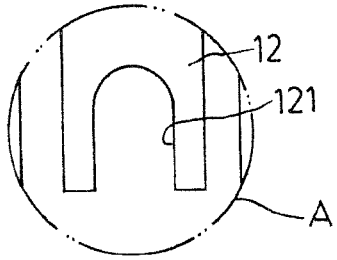
Figure 5C:
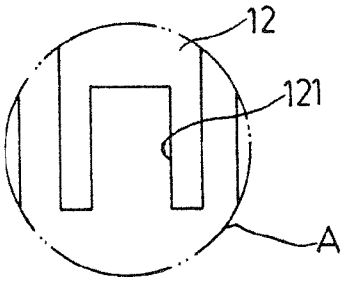

Referring to FIGS. 5A-5C, modifications can be made on the shape of the folding notch (121) formed in the bottom edge of each of the bearing seats (31) of the flexible core (10) and such modifications include, for example, an inverted V-shape, a rounded-end inverted U-shape, and a flat-end inverted U-shaped.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A coupling structure of a flexible core and a flexible base of a Christmas light string, the Christmas light string comprising at least one Christmas light, which comprises a flexible core, a flexible base, an LED, and two electrical wires, the flexible core having a top forming an open cavity, an outer circumferential surface in which a groove is defined, and a bottom comprising a spacer plate formed at a center thereof, the spacer plate having an upper portion having opposite sides on each of which a bearing seat is formed, the flexible base having a top forming an open cavity, which has an inner circumferential surface on which a projection is formed, the LED having a bottom from which a long and a short terminal pins extend, the two electrical wires having ends to each of which a conductive pad is mounted, the improvements comprising: the bearing seats that are arranged at the bottom of the flexible core each have a bottom edge in which a folding notch is formed, the two folding notches being of a one-long-one-short arrangement whereby one of the folding notches forming an opening in a wall of the corresponding bearing seat that is relatively long in a vertical direction and the other one of the folding notches forming an opening in a wall of the corresponding bearing seat that is relative short in the vertical direction.

2. The coupling structure of a flexible core and a flexible base of a Christmas light string according to claim 1, wherein the folding notches formed in the bottom edges of the bearing seats at the bottom of the flexible core are selectively of a shape of one of an inverted V, a rounded-ended inverted U, and a flat-ended inverted U.

* * * * *